US006645069B2

(12) United States Patent
Robb

(10) Patent No.: US 6,645,069 B2
(45) Date of Patent: Nov. 11, 2003

(54) METHOD AND APPARATUS FOR CASINO SYSTEM FOR, E.G., SKILL BASED GAMES

(75) Inventor: Robert W. Robb, Orem, UT (US)

(73) Assignee: Skill Safari, LLC, San Mateo, CA (US)

( * ) Notice: Subject to any disclaimer, the term of this patent is extended or adjusted under 35 U.S.C. 154(b) by 108 days.

(21) Appl. No.: 10/056,291

(22) Filed: Jan. 25, 2002

(65) Prior Publication Data

US 2002/0090991 A1 Jul. 11, 2002

Related U.S. Application Data

(62) Division of application No. 09/481,726, filed on Jan. 11, 2000, now Pat. No. 6,488,580.

(51) Int. Cl.[7] ..... A63F 9/24

(52) U.S. Cl. ..... 463/9; 463/23; 273/440

(58) Field of Search ..... 463/1, 9, 12–13, 463/16, 20, 23, 25, 29, 30, 31, 36, 40, 42, 43; 273/138.1, 138.2, 139, 236, 237, 292–243, 143 R, 429–430, 432, 118 R, 119 R, 121 R, 121 B, 440; 340/323 R; 700/91–93

(56) References Cited

U.S. PATENT DOCUMENTS 4,129,304 A 12/1978 Mager ..... 273/243
4,582,324 A 4/1986 Koza et al. ..... 273/138 A
4,685,677 A 8/1987 Demar et al. ..... 273/121 A
5,342,049 A 8/1994 Wichinsky et al. ..... 273/119 R
5,542,669 A 8/1996 Charron et al. ..... 463/13
5,655,961 A 8/1997 Acres et al. ..... 463/27
5,718,429 A 2/1998 Keller, Jr. ..... 273/274
5,741,011 A 4/1998 So et al. ..... 273/292
5,779,549 A 7/1998 Walker et al. ..... 463/43
5,816,918 A 10/1998 Kelly et al. ..... 463/16
5,823,872 A 10/1998 Prather et al. ..... 453/6
5,851,147 A 12/1998 Stupak et al. ..... 463/13
5,879,007 A 3/1999 Kasri ..... 273/292
5,882,258 A 3/1999 Kelly et al. ..... 463/11
5,961,386 A 10/1999 Sawaguchi ..... 463/43
6,007,426 A 12/1999 Kelly et al. ..... 463/16
6,092,806 A 7/2000 Follis ..... 273/138.1

*Primary Examiner*—Mark Sager

(57) ABSTRACT

The invention provides a method and apparatus for gaming. The method includes receiving a betting level; calculating a required score using a list of scores corresponding to the betting level and a house advantage; and using the required score as a score to be attained in a game of at least partial skill. The system includes a central server; at least one casino server connected to the central server via a communications link; and a gaming machine coupled to the casino server. At least one of the central server and the casino server are configured to: receive a betting level; calculate a required score using a list of scores corresponding to the betting level and a house advantage; and use the required score as a score to be attained in a game of at least partial skill.

9 Claims, 4 Drawing Sheets

METHOD AND APPARATUS FOR CASINO SYSTEM FOR, E.G., SKILL BASED GAMES

This application is a division of application Ser. No. 09/481,726 filed Jan. 11, 2000 now U.S. Pat. No. 6,488,580.

BACKGROUND OF THE INVENTION

Gambling games have existed since antiquity. Most of these games are based heavily on chance. Some, such as slot machines, are based entirely on chance. The others, such as blackjack and craps, require some skill for "success", where "success" is of course measured against an inherent house advantage.

Games of pure or primarily skill have not previously been successfully used in casinos because the skill element can overwhelm the inherent house advantage, thus making such games unprofitable.

Games of skill, however, can be highly attractive to players who enjoy the possibility of using their skills and wits to overcome odds against them. Thus, there is a need for a casino or other gaming system that allows players to play games of skill but which maintain a predetermined house advantage.

SUMMARY OF THE INVENTION

The present invention addresses the needs described above.

In one aspect, the invention is directed to a method for gaming. The method includes receiving a betting level; calculating a required score using a list of scores corresponding to the betting level and a house advantage; and using the required score as a score to be attained in a game of at least partial skill.

Implementations of the invention may include one or more of the following. The game of at least partial skill may be blackjack or another such video game. The calculating further comprises computing a first number corresponding to the scores in the list and adding a second number proportional to the house advantage. The first number may be an average, a weighted average, or a median, etc. The game may end when a player receives the required score or, in a timed game, when the game is timed out.

In another aspect, the invention is directed to a system for gaming. The system includes a central server; at least one casino server connected to the central server via a communications link; and a gaming machine coupled to the casino server. At least one of the central server and the casino server are configured to: receive a betting level; calculate a required score using a list of scores corresponding to the betting level and a house advantage; and use the required score as a score to be attained in a game of at least partial skill.

Implementations of the invention may include one or more of the following. The casino server may be located within a casino. An end-user machine may be coupled to the casino server via a communications link.

Advantages of the invention include one or more of the following. Skilled games may be the subject of casino gambling. Players may be encouraged to play with the incentive that their skill level may enable them to win more money than games of pure chance. These advantages and others will become more apparent by the description that follows, including the drawings and claims.

DETAILED DESCRIPTION OF THE PREFERRED EMBODIMENTS

Figure 1:
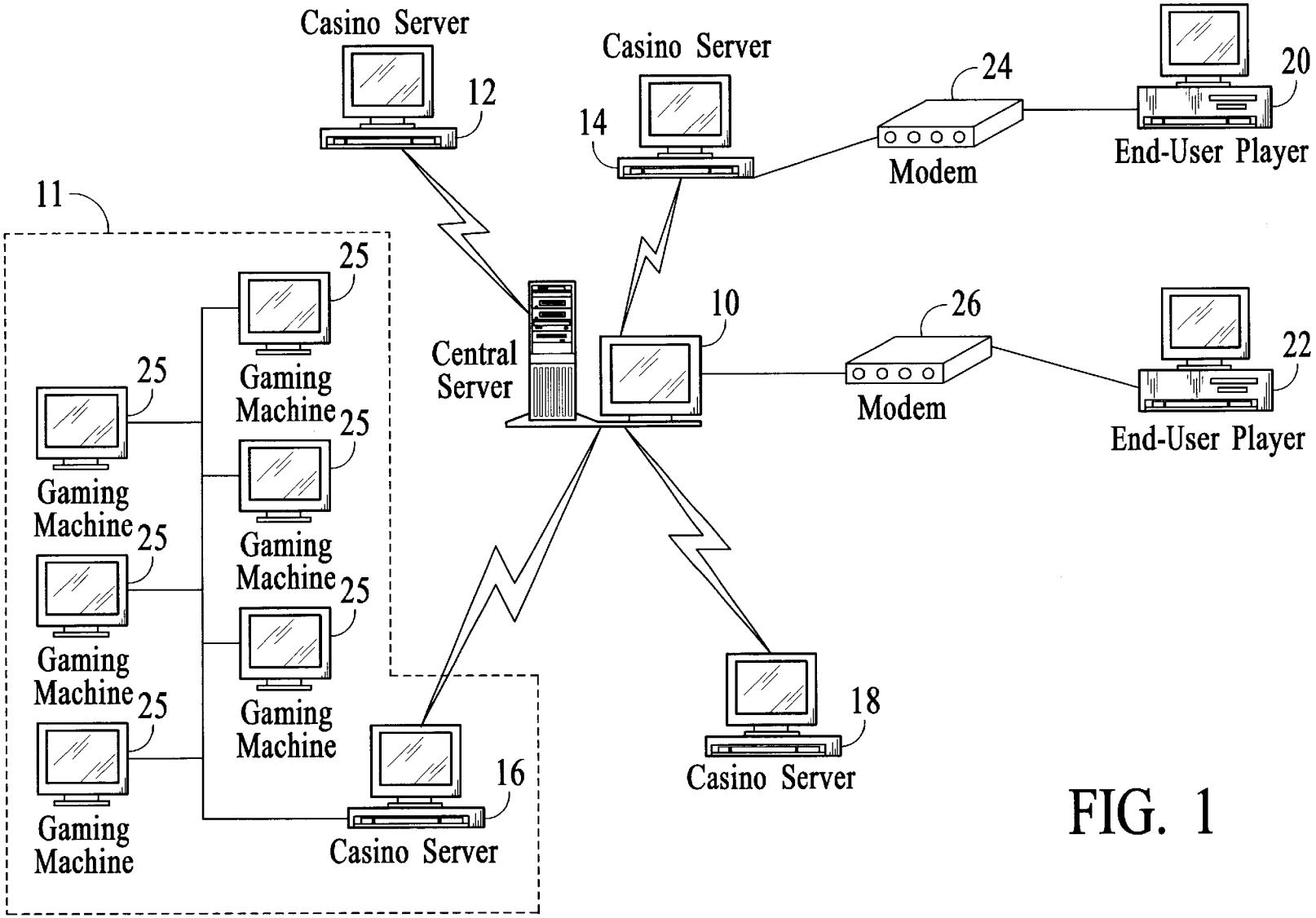
FIG. 1 shows a network layout of a gaming system according to a first embodiment of the system of the present invention.

Referring to FIG. 1, a network layout of a gaming system is shown. A central server 10 is depicted with numerous connections to a plurality of casino servers 12, 14, 16, and 18. Casino server 16 is shown within a casino 11. It will be apparent to one of skill in the art using the teachings of the present specification that variations may be made even of this simple theme. For example, casino servers 12–18 may themselves perform the functions of central server 10, thus eliminating the need for a central server 10. However, advantages may inure to the use of such a central server 10 as will be shown.

Casino servers 12–18, located within or communicatively coupled to a casino such as casino 11, may each service a number of gaming machines 25. Gaming machines 25 will be described in more detail below.

Players not located in a casino may also use the gaming system. For example, in an alternative communications setup, also shown in FIG. 1, casino servers such as casino server 14 may be linked via a modem 24 to an end-user player computer 20. Alternatively, an end-user player computer 22 may be linked directed via a modem 26 to central server 10. Of course, in cases where the gaming machines are used for gambling, security systems should be instituted to ensure that only players located in legal gambling locations could log in and use the system.

A benefit to the above system is that the use of an on-site casino server allows the management of a casino to vary treatment to players if desired such as to high rollers. Such varied treatment is often afforded a casino's best players currently, and this treatment can be continued in methods using the present invention.

Central server 10 performs numerous functions. One of these functions may be to receive all the scores of all the players of a particular game of skill from all casino servers connected to central server 10. These aggregated scores are used to calculate a betting level (described below). Central server 10, for reasons also described below, may also calculate an average score.

Figure 2:
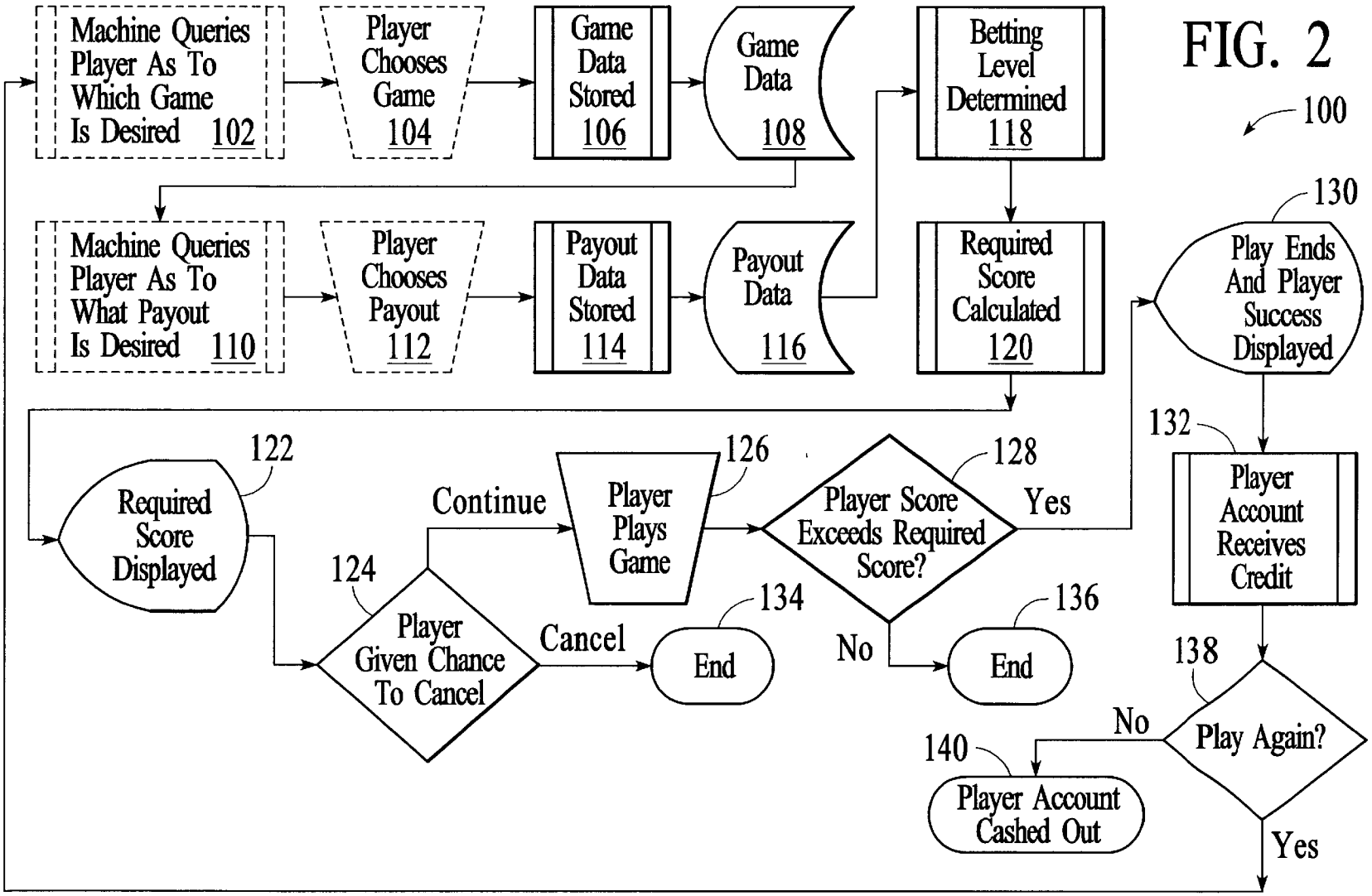
FIG. 2 shows a flowchart of a first embodiment of the method of the present invention.

Referring to FIG. 2, an embodiment of a method 100 according to the present invention is now described. The gaming machine 25 may query the player as to what game is desired to be played (step 102). This step is optional as is indicated by a dotted box. This step would only be used for gaming machines 25 offering a plurality of game choices. Game choices may include blackjack, poker, slots, or games of skill such as arcade games or even sporting games as are common in bars and restaurants. The game choices are only limited by the mechanics of the game console. For convenience, a game is described below which is purely a game of skill. In other words, the player receives a score based only and solely on how skillfully they play the game. Of course, the invention is not to be limited solely to such games.

The player thus chooses which game to play (step 104). Game data is stored as to which game was chosen (step 106). This game data is referred to in the flow chart as game data 108.

The machine may then query the player as to what payout is desired (step 110). This step is also optional because the game data may be fixed at, e.g., 1:1. The player chooses the payout (step 112), and the payout data is stored (step 114) as payout data 116.

The player betting level is determined (step 118). In essence, this determination is simply a storage of the amount the player has wagered on the game.

A required score is then calculated from a number of factors (step 120). This step is also described in more detail below. The factors may include (but are not limited to) the payout desired, the aggregate of player scores, and the house advantage.

The required score is then displayed to the player (step 122), who is then given a chance to cancel (step 124). If the player cancels, the game ends (step 134). If the player does not cancel, then the player plays the game (step 126).

In one embodiment, shown in FIG. 2, if the player achieves a score that is determined to be greater than or equal to the required score (step 128), then the game ends and the success of the player is indicated and displayed (step 130). If the player score does not exceed the required score, then game ends (step 136). Of course, the player may be given a chance to play again if desired. In the case where the player wins, the player's account may be duly credited (step 132) and the player may be given a chance to play again (step 138). If the player chooses to play again, the machine may again query the player as to what game is desired (step 102). If the player does not so choose to play again, the player account may be optionally cashed out (step 140).

Figure 3:
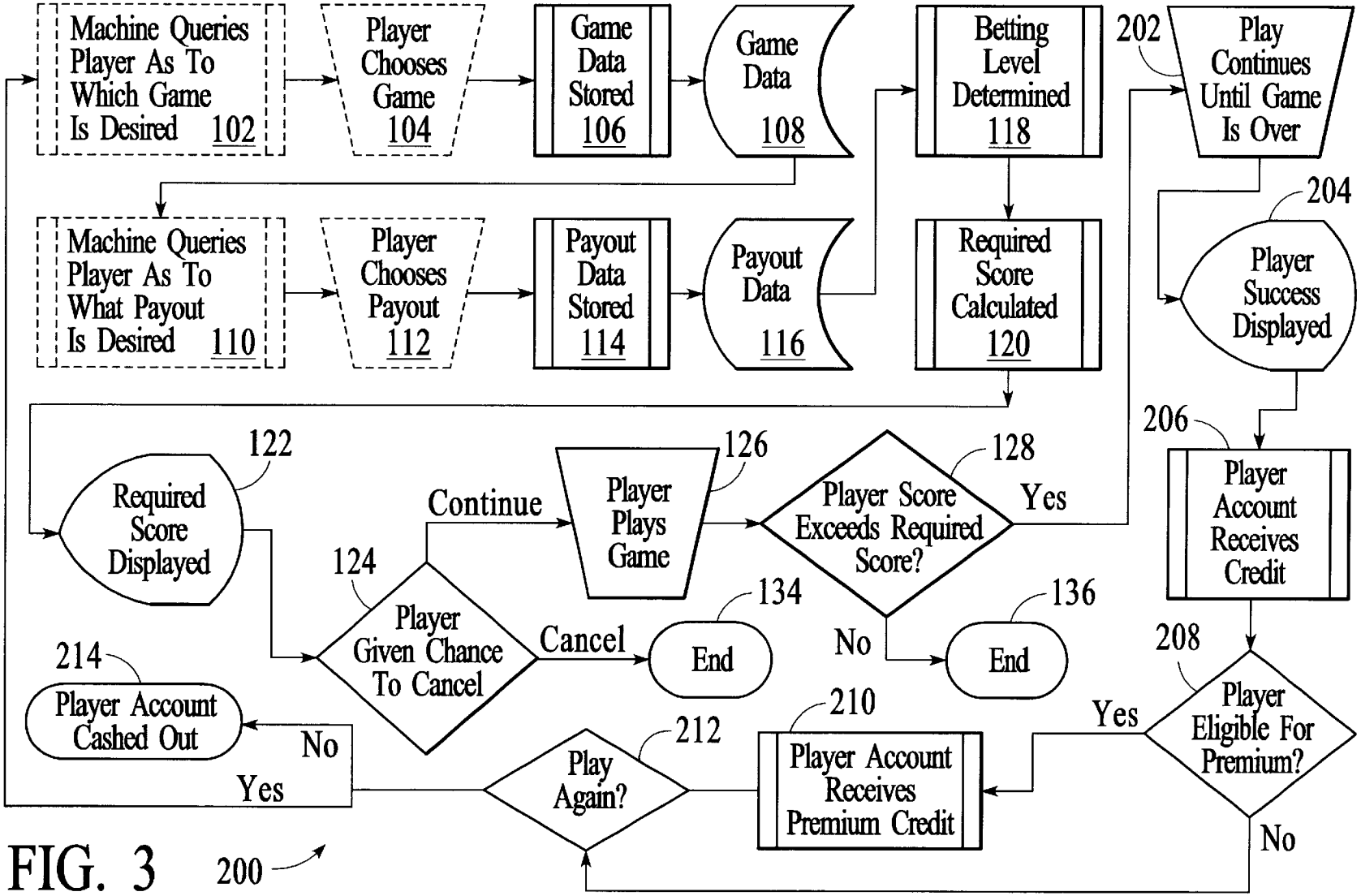
FIG. 3 shows a flowchart of a second embodiment of the method of the present invention.

In a second embodiment, shown in FIG. 3, many of the steps are similar to those of FIG. 2. However, in FIG. 3, if the player score exceeds the required score, play may continue until a natural termination point of the game is reached. At this point, the player may have achieved a score well in excess of the required score. Such an exceptional score may qualify the player for premium prizes such as a progressive jackpot. The progressive jackpot may be funded by losing bets.

Figure 4:
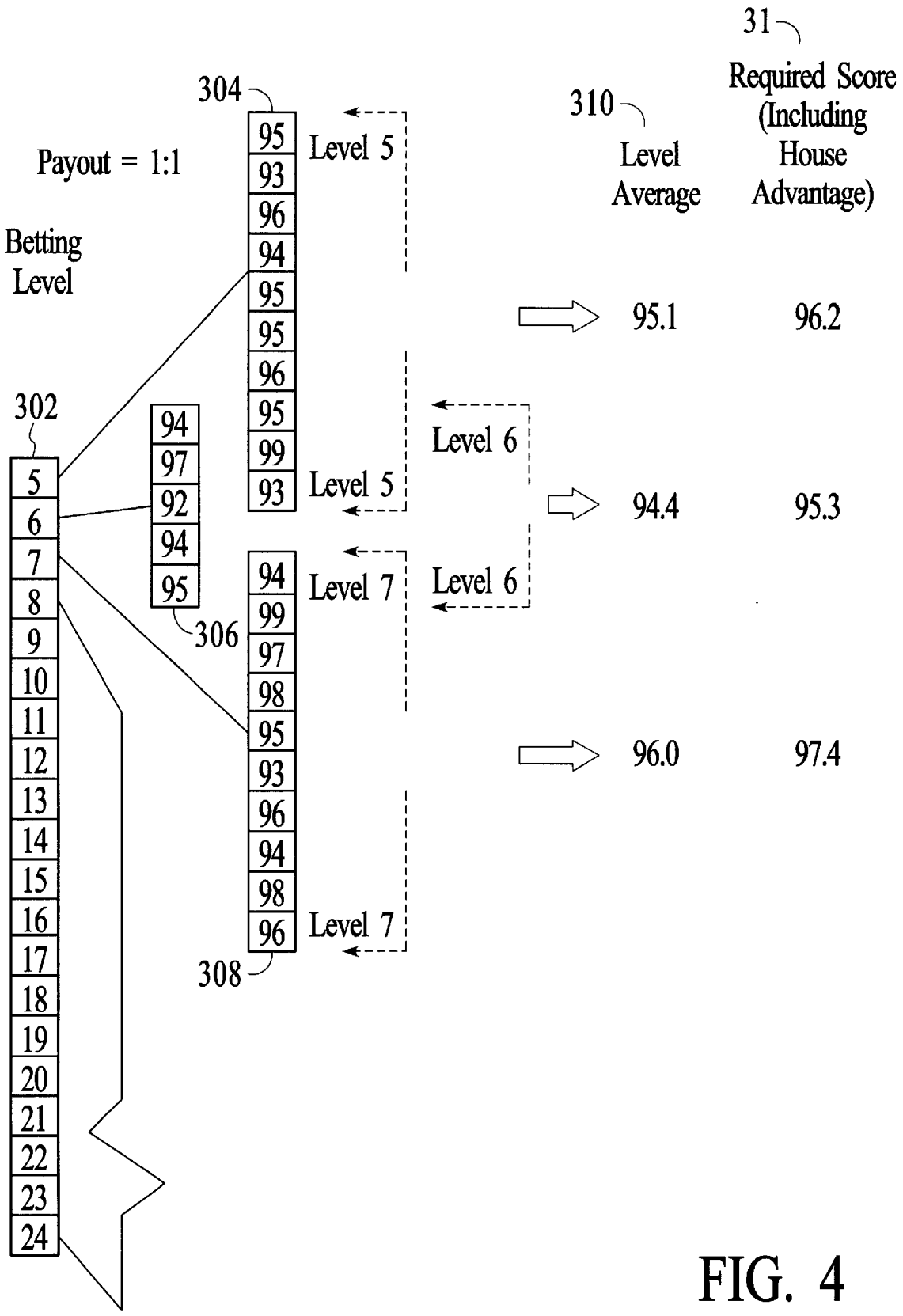
FIG. 4 shows a layout of a betting level scheme, which may be implemented in the system and method according to the embodiments of the invention.

The method whereby betting levels and required scores are determined is now described in more detail. Referring to FIG. 4, an example of a betting level and required score scheme are shown. It should be noted that FIG. 4 is only meant for illustration. A real system would have a far greater number of score entries and betting levels. The required scores shown are merely estimates based on a sample house advantage. A real system may construct a statistical model of the game scores, compute a statistically accurate house advantage, and thus calculate an accurate required score.

As shown in FIG. 4, a number of betting levels 302 are shown. Each betting level has associated with it a list of scores (lists 304, 306, and 308). These lists of scores are lists of the aggregated scores of all the games played associated with a particular betting level. For example, the aggregated scores associated with betting level 5 are shown by list 304, and so on. Of course, the lists and betting levels shown in FIG. 4 are just sample data and do not necessarily represent actual scores.

In the first embodiment of the method described above, it was noted that the game may be halted at the point where the player exceeds the required score. For purposes of the betting level list, the casino server may, in appropriate games, add to the player's score (as reported to the list) the average number of points the player was winning at a moment in time, such as when the game ended, multiplied by a remaining time (if the game is subject to a time limit). Such a facility may increase the overall accuracy of the list.

Given a particular wager, which determines the betting level, the associated list and house advantage may uniquely determine the required score. The method of determination is somewhat arbitrary and depends on the casino. For example, the method may be as simple as taking a median or mean of the list and adding a non-zero house advantage (e.g., 2%). On the other hand, more sophisticated systems take account of the fact that adding a house advantage to a score is not the same as adding the house advantage to a list of player scores.

The required score may also depend on the desired payout, a variable that as noted above may be optionally chosen by the player in some gaming machines. For example, if a player desired a 20:1 payout instead of 1:1, the required score may be correspondingly higher, e.g, the casino server or central server may require that the player score in the top 3% of their betting group (if the correct odds would indicate the top 5%) to account for the required house advantage.

In the case where the player is the first player to place a particular wager or betting level, the average which can be used is the average over all of the lists. Alternatively, an average can be computed based on betting levels close to the new betting level.

Of course, it will be clear to one of skill in the art that the above description only describes certain embodiments of the invention and accordingly that the scope of the invention is limited only by the scope of the claims appended hereto, and equivalents thereof. For example, while many steps are shown in the accompanying flowcharts and figures, not all the steps are necessarily required for each practice of the invention.

What is claimed is:

1. A gaming method, comprising:

a. Receiving a betting level;

b. Calculating a required score using a list of scores corresponding to the betting level and a house advantage; and c. Using the required score as a score to be attained in a game of at lease partial skill.

2. The gaming method of claim 1, wherein the game of at least partial skill is blackjack.

3. The gaming method of claim 1, wherein the game of at least partial skill is a video game.

4. The gaming method of claim 1, wherein the calculating further comprises computing a first number corresponding to the scores in the list and adding a second number proportional to the house advantage.

5. The gaming method of claim 4, wherein the first number is an average.

6. The gaming method of claim 4, wherein the first number is a weighted average.

7. The gaming method of claim 4, wherein the first number is a median.

8. The gaming method of claim 1, further comprising ending the game of at least partial skill once a player attains the required score.

9. The gaming method of claim 1, wherein the game of at least partial skill has a time limit, and further comprising ending the game of at least partial skill once a player has reached the time limit.

* * * * *